US012692676B2

(12) United States Patent
Hillman et al.

(10) Patent No.: US 12,692,676 B2
(45) Date of Patent: Jul. 28, 2026

(54) COMPOSITE FLUID RETAINING BARRIER SYSTEM

(71) Applicant: SNBC Inc., Sherwood Park (CA)

(72) Inventors: John R. Hillman, Denver, CO (US); Shawn Beamish, Sherwood Park (CA); Marlin Belanger, Leduc (CA)

(73) Assignee: SNBC Inc., Sherwood Park (CA)

( * ) Notice: Subject to any disclaimer, the term of this patent is extended or adjusted under 35 U.S.C. 154(b) by 405 days.

(21) Appl. No.: 18/466,443

(22) Filed: Sep. 13, 2023

(65) Prior Publication Data

US 2024/0084535 A1 Mar. 14, 2024

Related U.S. Application Data

(60) Provisional application No. 63/405,977, filed on Sep. 13, 2022.

(51) Int. Cl.
*E02B 7/50* (2006.01)
*E02B 7/20* (2006.01)

(52) U.S. Cl.
CPC ..... *E02B 7/50* (2013.01); *E02B 7/205* (2013.01)

(58) Field of Classification Search
CPC ..... E02B 7/20; E02B 7/22; E02B 7/40; E02B 7/50
See application file for complete search history.

(56) References Cited

U.S. PATENT DOCUMENTS 2,040,721 A * 5/1936 Zimmermann ..... E02B 7/20 405/99
5,046,898 A 9/1991 McKinney
5,797,588 A * 8/1998 Bennett ..... F16K 3/188 251/175
6,042,301 A * 3/2000 Sovran ..... E04H 9/145 405/114
7,037,039 B1 * 5/2006 Werts ..... E02B 7/40 405/87

(Continued)

FOREIGN PATENT DOCUMENTS

CN 208328855 U * 1/2019
FR 2720768 A1 * 12/1995 ..... E02B 5/08

(Continued)

OTHER PUBLICATIONS

International Patent Application No. PCT/IB2023/000545 International Report On Patentability (Mar. 27, 2025).

(Continued)

*Primary Examiner* — Janine M Kreck
(74) *Attorney, Agent, or Firm* — Ice Miller LLP

(57) ABSTRACT

A liquid retaining barrier comprises a plurality of vertically stacked members, each member having first and second ends, a length between the first and second ends, first and second sides, and top and bottom faces. An outer shell extends around a perimeter formed by the first and second sides and first and second faces of the member, and defines an inner core space. A conduit comprising a compression reinforcement material is positioned in the inner core space and forms an approximately parabolic curve extending between the first and second ends. A side of the outer shell is tangent to the curve of the conduit at about the mid-point of the length of the member.

22 Claims, 11 Drawing Sheets

(56) References Cited

U.S. PATENT DOCUMENTS

| | | | | |
|---|---|---|---|---|
| 7,562,499 | B2 * | 7/2009 | Hillman | E01D 2/02 52/607 |
| 7,895,799 | B2 | 3/2011 | Hillman et al. | |
| 8,141,307 | B2 | 3/2012 | Hillman et al. | |
| 2013/0022402 | A1 | 1/2013 | Cardis et al. | |
| 2013/0022403 | A1 | 1/2013 | Freitag et al. | |
| 2021/0107177 | A1 | 4/2021 | Giles | |

FOREIGN PATENT DOCUMENTS

| | | | | | |
|---|---|---|---|---|---|
| JP | 2000234323 | A | * | 8/2000 | |
| JP | 2016113757 | A | | 6/2016 | |
| JP | 6653839 | B1 | | 2/2020 | |
| KR | 101120084 | B1 | * | 3/2012 | E02B 7/34 |
| WO | WO-2007118922 | A1 | * | 10/2007 | E02B 3/00 |

OTHER PUBLICATIONS

International Patent Application No. PCT/IB2023/000545 International Search Report, Written Opinion of the International Searching Authority (Mar. 28, 2024).

* cited by examiner

COMPOSITE FLUID RETAINING BARRIER SYSTEM

This application claims the benefit of U.S. Provisional Application No. 63/405,977, filed Sep. 13, 2022, which is hereby incorporated by reference herein in its entirety.

BACKGROUND OF THE INVENTION

The disclosure of the present application relates generally to barrier structures designed to retain water and other fluids, which may include, but is not limited to, locks, dams, and dry docks.

There are numerous types of barrier structures designed to retain water and allow for the separation of a body of water into two or more portions, while allowing for a variation in the elevations of the liquid on either side of the barrier. For many or most of the structures designed to allow for a separation of retained water, this barrier comprises a movable and/or removable structure that can be opened or removed, permanently or temporarily, when the liquid on both sides of the barrier is maintained at the same elevation or during periods when said barrier is not required to retain the liquid on one side or the other of the dividing barrier.

In the case of a waterway, such as a canal for example, this barrier might comprise one or more lock gates resembling doors that pivot on one side and rotate to block the canal or passage in the waterway. In the case of a dam, this barrier might comprise a plurality of individual steel or timber planks that are stacked within vertical structural members such as steel soldier piles to effectively create a vertical barrier for the fluid on the side of the dam with the higher water elevation. In the case of a dry dock, this barrier might comprise a ballasted steel structure positioned in tapered, vertical steel slots effectively forming a bulkhead between a body of water and the confines of the dry dock. Upon removing the ballast from the barrier, with the water elevations equalized on both sides, the buoyancy force will allow the barrier to be lifted out of the tapered, vertical slots and the barrier can be floated out of the way to allow for vessels to pass from the dry dock to the adjacent body of water.

In the fluid retaining structures identified, the barrier conventionally comprises a skin reinforced by steel, concrete, or timber beams, that provides in a relatively watertight diaphragm with adequate strength and stiffness to resist the hydrostatic pressures resulting from the differential in the fluid elevations on opposite sides of the barrier. However, these types of barriers are very heavy and are susceptible to corrosion and/or deterioration over time. In the case of timber barriers, the water absorptive characteristics of the organic timber elements result in very limited life cycles for the structures due to rotting of the individual elements and corrosion of the connections between the beams, and it is increasingly difficult to find timbers of sufficient size to rebuild rotting and decaying components on older structures.

There is believed to be a significant need for water retaining barrier systems and structural members that provide greater resistance to corrosion and that can be built not only at a competitive cost, but also with a reduction in the self-weight of the structural members as it relates to transportation and construction costs.

SUMMARY OF THE INVENTION

In one embodiment, a liquid retaining barrier comprises a plurality of vertically stacked members. Each member comprises opposite first and second ends, a length between the first and second ends, opposite first and second sides, and opposite top and bottom faces. An outer shell extends at least partially around a perimeter formed by the first and second sides and first and second faces. The outer shell defines an inner core space within the outer shell. A conduit is positioned in the inner core space and extends between the first and second ends, the conduit comprising a compression reinforcement material. A core material at least partially fills the inner core space between the outer shell and conduit. The conduit has a curve with a concave side facing the first side and a convex side facing the second side. The second side is tangent to the curve of the conduit at a point between the first and second ends.

In one embodiment, a modular barrier comprises a plurality of vertically stacked members that are coupled together, including first and second members. Each member comprises opposite first and second ends, a length between the first and second ends, opposite inner and outer sides, and opposite top and bottom faces. An outer shell extends at least partially around a perimeter of the member formed by the inner side, outer side, top face, and bottom face, the outer shell having an inner core space. A curved conduit is positioned in the inner core space and extends between the first and second ends, the conduit having a concave side facing the member inner side, and a convex side facing the member outer side.

In one embodiment, a modular barrier comprises first and second gates. Each gate comprises a plurality of vertically stacked members that are coupled together. Each member comprises opposite first and second ends, a length between the first and second ends, opposite inner and outer sides, and opposite top and bottom faces. An outer shell extends at least partially around a perimeter of the member formed by the inner side, outer side, top face, and bottom face, the outer shell having an inner core space. A curved conduit is positioned in the inner core space and extends between the first and second ends. The conduit has a concave side facing the member inner side, and a convex side facing the member outer side. The vertically stacked members include a top member and a bottom member. At least one of the top and bottom members has a first end comprising a hub with an opening for receiving a pin, wherein the gate is rotatable on the pin. The vertically stacked members of the second gate are arranged in a mirror image of the vertically stacked members of the first gate. The barrier is moveable between a closed position with the first and second gates rotated toward each other and the member second ends of the first gate are in contact with the member second ends of the second gate, and an open position with the first and second gates rotated away from each other and the member second ends of the first gate are rotated away from contact with the member second ends of the second gate.

In one embodiment, a vertical barrier comprises an outer shell enclosing an inner core space. The outer shell has opposite first and second vertical faces, and opposite first and second ends. A curved conduit is positioned in the inner core space and extends between the first and second ends. The conduit has a concave side facing the first vertical face and a convex side facing the second vertical face.

BRIEF DESCRIPTION OF THE DRAWINGS

Further understanding of the disclosure and advantages of the present application will become apparent upon reading the following detailed description in conjunction with the accompanying drawings, which illustrate embodiments of the disclosure and together with the detailed description serve to explain the principles of the disclosure.

DETAILED DESCRIPTION OF THE INVENTION

Figure 1:
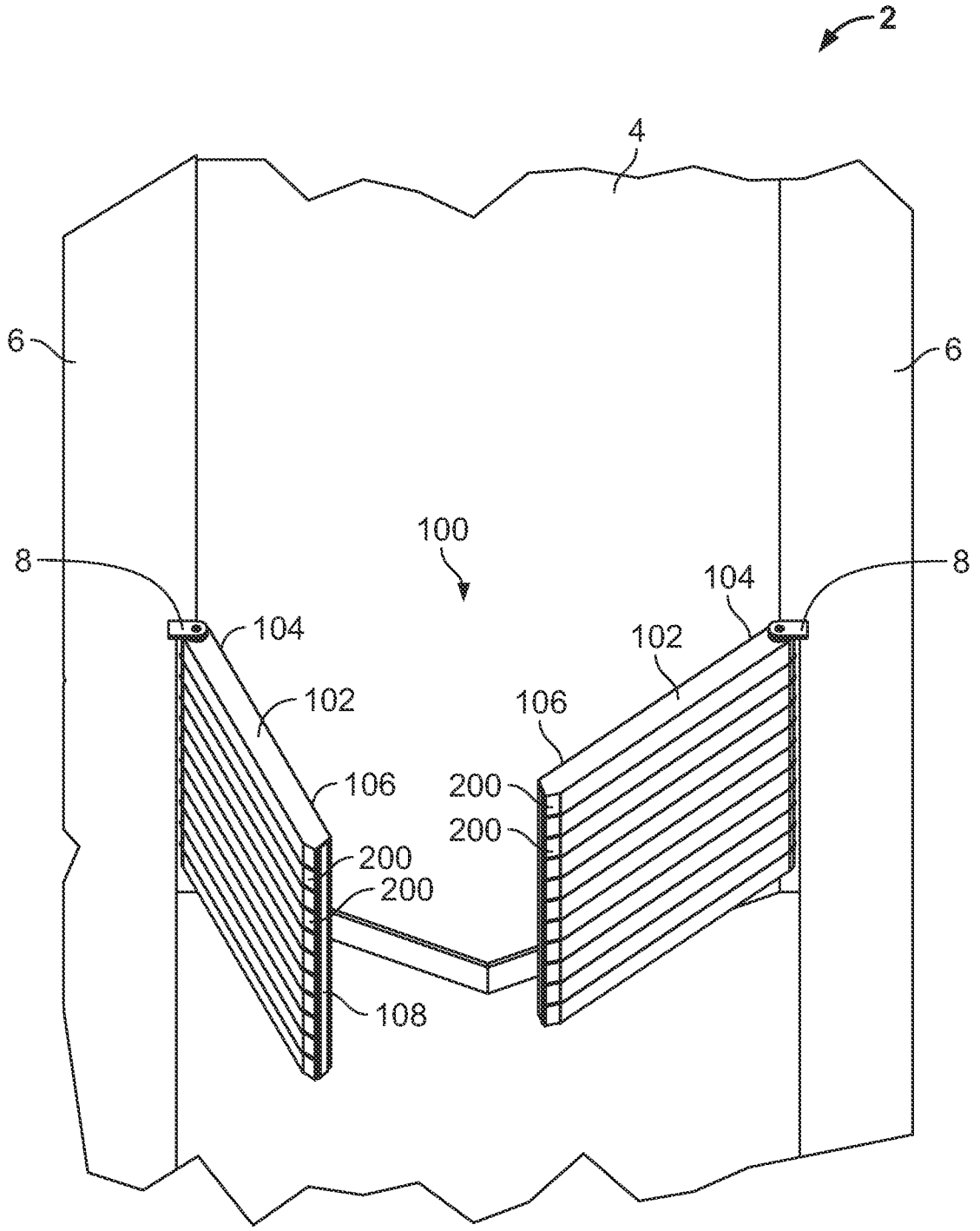
FIG. 1 is a perspective view of a waterway navigation lock, including an embodiment of a lock gate comprising composite members according to the present disclosure.

Reference will now be made to the embodiments illustrated in the drawings and specific language will be used to describe the same. It will nevertheless be understood that no limitation of scope is intended by the description of these embodiments.

Vertical barrier structures, such as liquid retaining barriers (e.g., lock gates, sluice gates, dry dock gates) are described and shown that comprise one or more vertically stacked planks or members. Each member has a composite structure comprising a shell with an interior core, and a conduit within the interior core that comprises a compression reinforcement. The interior core of the shell may also contain a core fill material that at least partially fills the interior core, and preferably surrounds the conduit. The member may further include a tension reinforcement. In a preferred embodiment, the barrier comprises a plurality of vertically stacked members that are coupled together to form the barrier.

Figure 2:
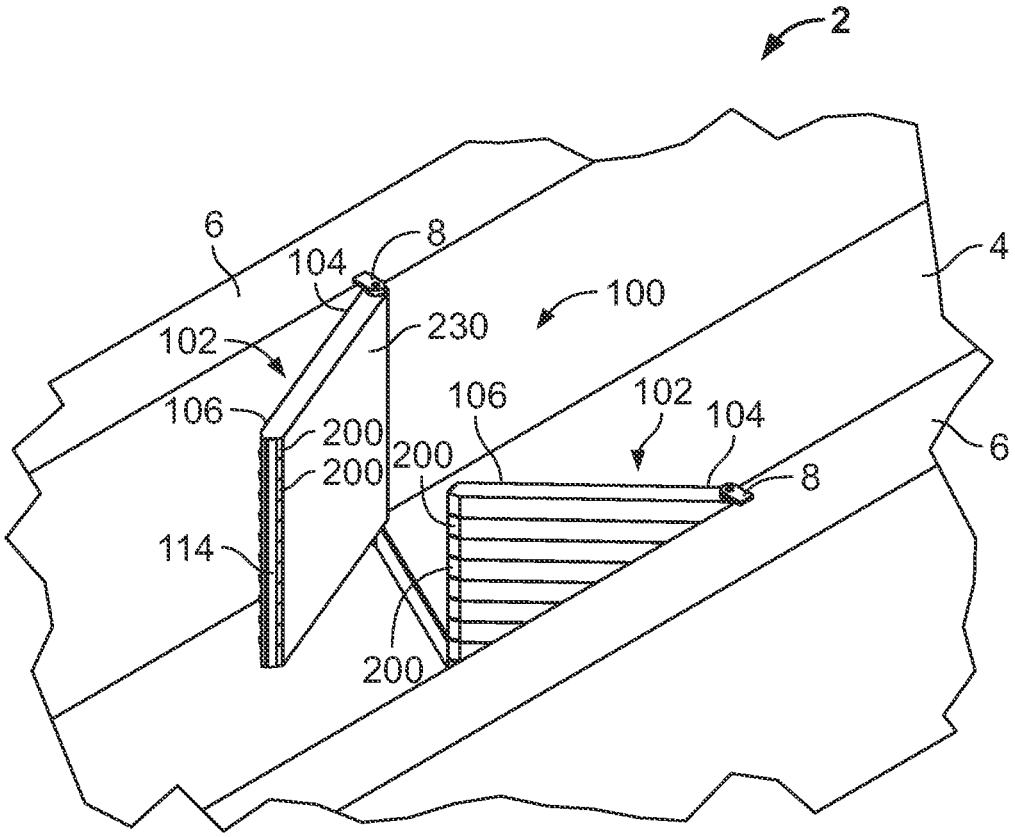
FIG. 2 is an alternative perspective view of the navigation lock of FIG. 1.
Figure 3:
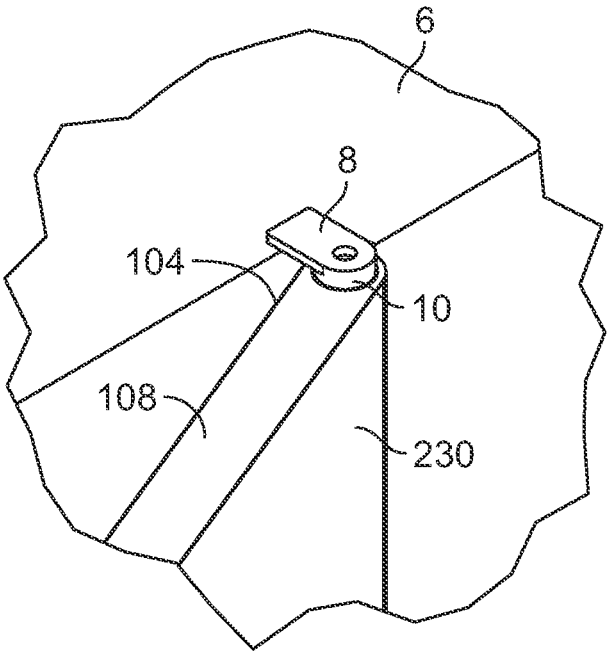
FIG. 3 is a detail perspective view of the navigation lock of FIG. 1, showing the lock gate pintle.

In one embodiment, the vertically stacked composite members comprise a lock gate. FIGS. 1-3 show an illustrative waterway navigation lock 2 incorporating a lock gate 100. Lock 2 comprises a chamber 4 defined by opposite side walls 6, with lock gate 100 positioned at one end. Lock gate 100 is a double leaf gate or mitre lock constructed of two opposed lock gate leaves 102 that are rotatable between open and closed positions. Each gate leaf 102 has opposite ends 104 and 106, and a top 108 and bottom 110. End 104 is rotatably coupled to a lock side wall 6, such as at a quoin pier formed at the side wall. In one embodiment, leaf end 104 is rotatably coupled to side wall 6 by a pivot 8 with a pin 10, such as pintles 8 that are attached to lock side wall 6. Pintles 8 have pinions 10 for rotatably supporting leaf end 104. In one embodiment, gate leaf end 104 is supported by pintles 8 positioned at the top 108 and bottom 110 of gate leaf 102.

Figure 4:
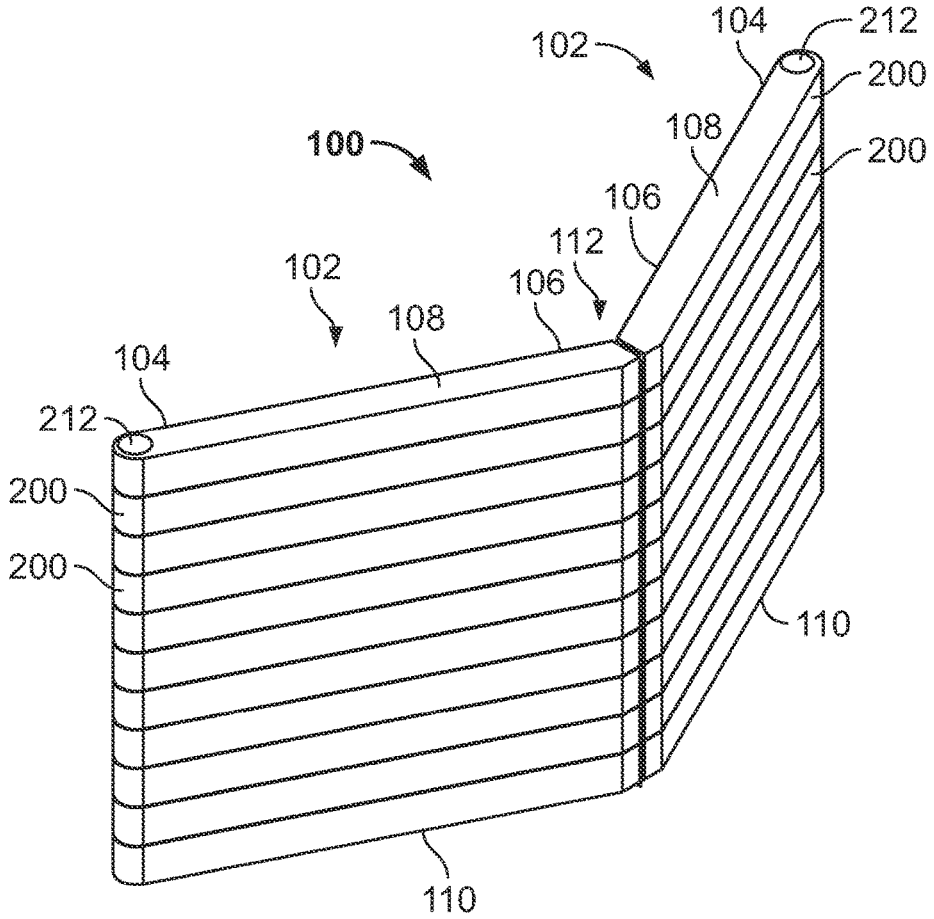
FIG. 4 is a perspective view of the lock gate of FIG. 1, in a closed position.
Figure 5:
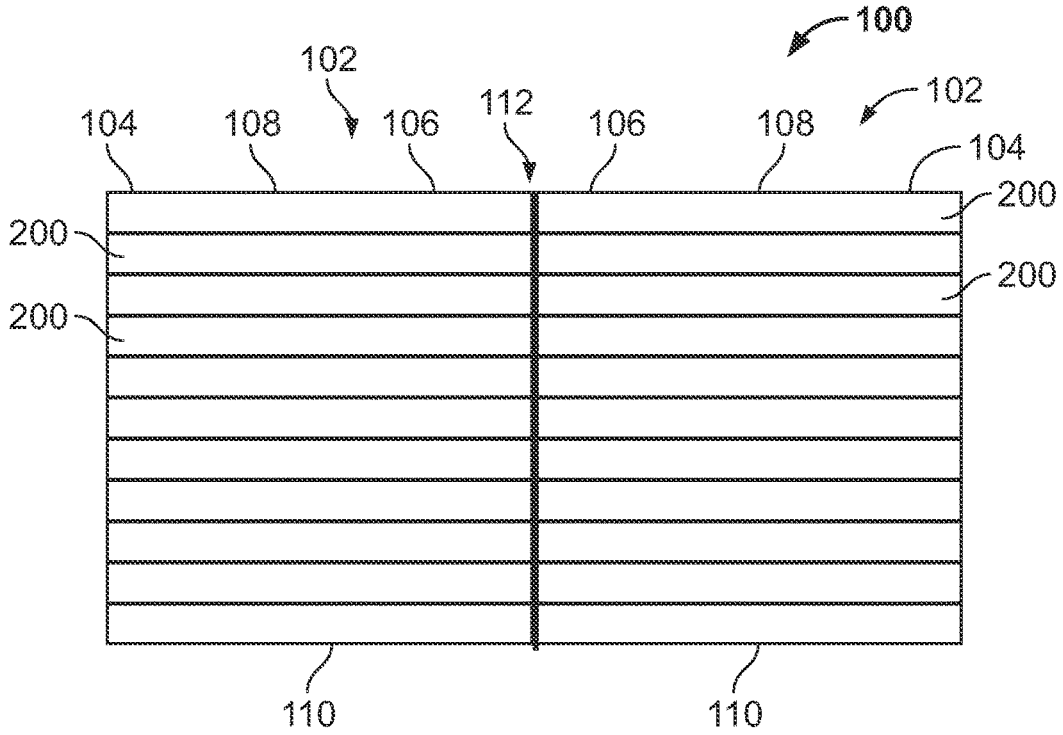
FIG. 5 is a rear elevation view of the lock gate of FIG. 4.
Figure 6:
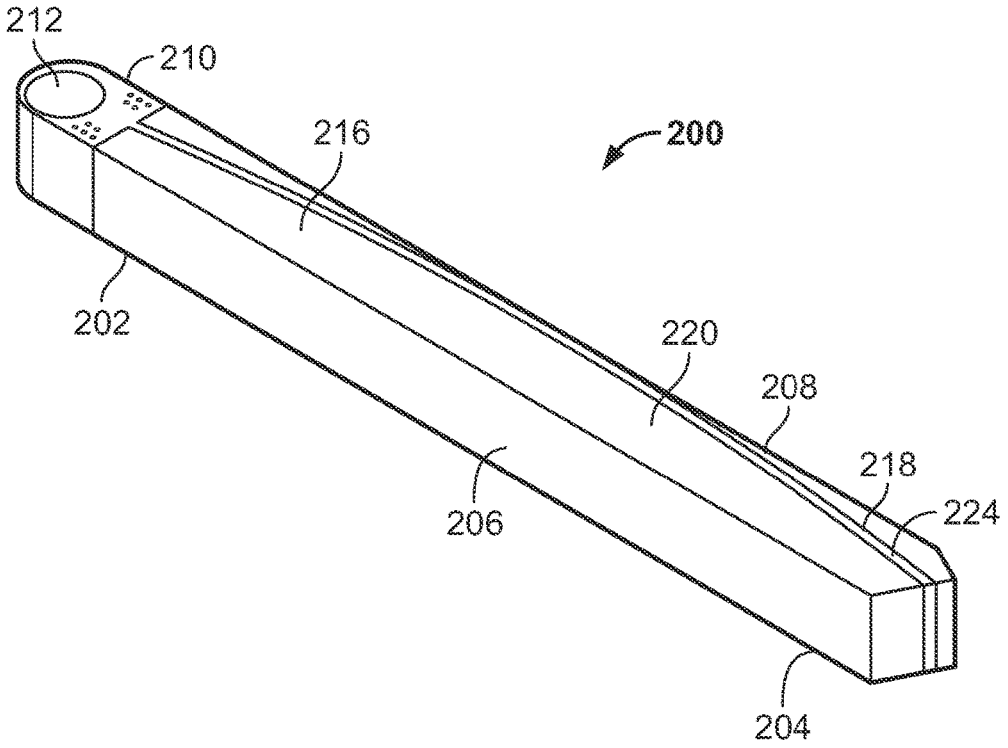
FIG. 6 is a perspective section view of an embodiment of a composite member according to the present disclosure.
Figure 7:
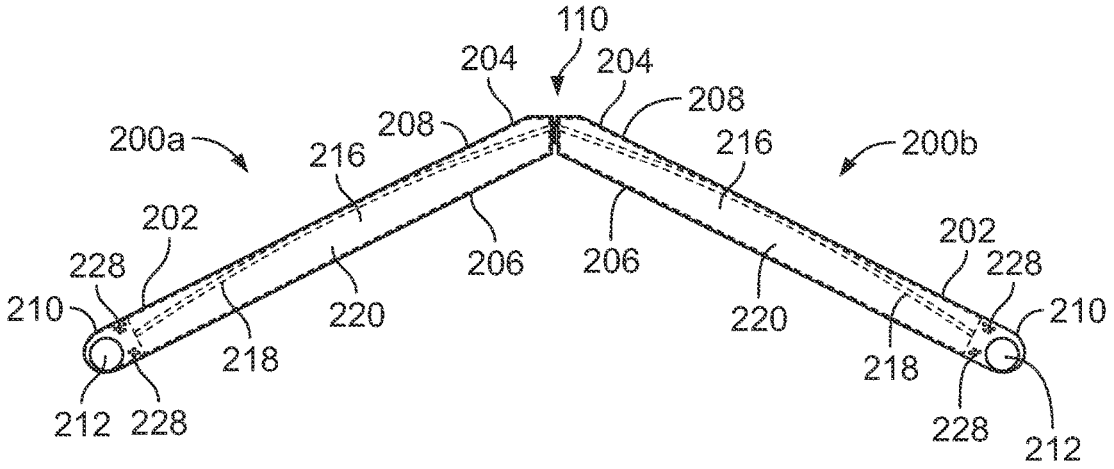
FIG. 7 is a top view of the lock gate of FIG. 4, showing hidden lines.
Figure 8A:
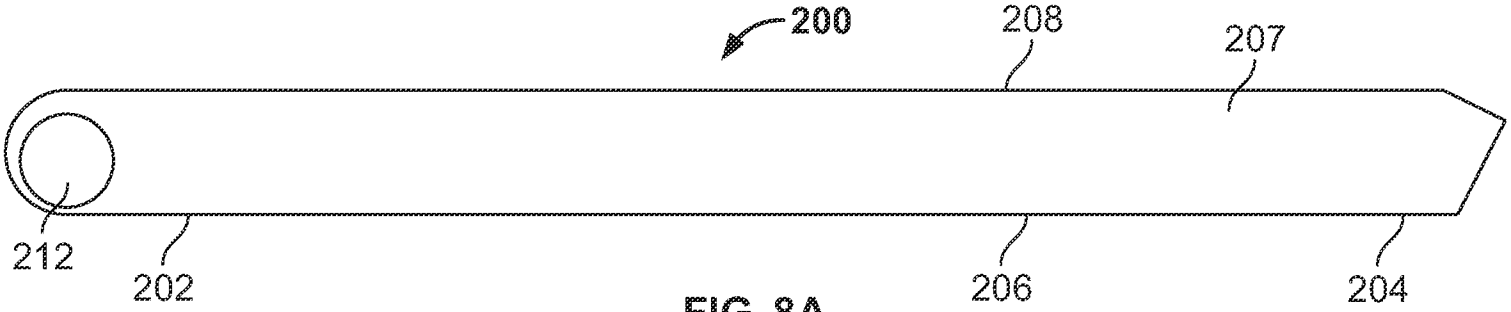
FIG. 8A is a top view of the composite member of FIG. 6.
Figure 8B:
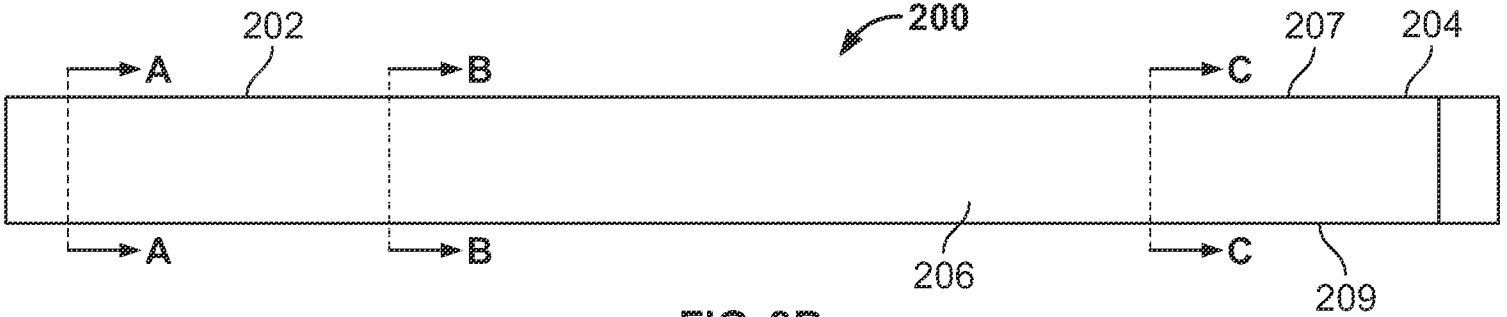
FIG. 8B is a rear elevation view of the composite member of FIG. 8A.

In the open position, gate leaves 102 and ends 106 are rotated away from each other, toward lock walls 6. Recesses 12 may be formed in lock walls 6 that are sized and shaped to receive gate leaves 102 in the open position. In the closed position, gate leaves 102 and ends 106 are rotated towards each other to form a mitre joint 112 between gate leaf ends 106. A seal 114 may be positioned at gate leaf end 106 of one or both gate leaves 102, to improve the seal of mitre joint 112 in the closed position. FIGS. 4 and 5 show an example of gate leaves 102 in the closed position.

Each lock gate leaf 102 comprises one or more vertically stacked, horizontal planks or members 200. FIGS. 6-9 show an embodiment of a member 200. Each member 200 has a pivot end 202 and an opposite mitre end 204, a length between the pivot and mitre ends, opposite inner and outer sides 206 and 208, and opposite top and bottom faces 207 and 209. The outer side generally refers to the side experiencing a horizontal load, such as the water pressure on the upstream side of a lock gate, and the inner side generally refers to the opposite or downstream side.

A pivot hub or pintle hub 210 is positioned at member pivot end 202, that has an opening 212 which is sized and shaped to receive a pivot pin such as pintle pin 10. Mitre end 204 is configured to conform to the mitre end of another member 200, to form a mitre joint 112 when gate leaves 102 are in the closed position.

In one embodiment, member 200 is a composite beam that comprises an outer shell 214 which defines an inner core space 216 within the outer shell. Outer shell 214 extends around or partially around the perimeter of member 200 formed by the sides 206 and 208, and faces 207 and 209. Outer shell is preferably formed of a corrosion resistant material such as plastics or resins known in the art. In one embodiment, the outer shell material is a glass fiber reinforced polymer, such as a vinyl ester resin reinforced by glass fibers that are optimally oriented to resist the anticipated forces in the composite member.

Outer shell 214 may also include a top shear flange (not shown) that extends along the length of member top face 207 and/or a bottom shear flange (not shown) that extends along the length of member bottom face 209. All of the components of the outer shell 214 may be fabricated monolithically using a vacuum assisted resin transfer method or using other manufacturing processes such as three-dimensional printing.

Inner core 216 comprises a conduit 218, and a core material 220. Conduit 218 is positioned in inner core 216 and extends longitudinally between member ends 202 and 204. Conduit 218 preferably has a configuration that is designed to resist the horizontal pressures resulting from the differential elevations of the fluid on either side of the composite lock gate leaf 102—e.g., in the same manner as an arch structure. In one embodiment, conduit 218 is a continuous tube having a curve with a concave side that faces member inner side 206, and a convex side that faces member outer side 208. In another embodiment, the curve of conduit 218 is approximately parabolic. In a preferred embodiment, member outer side 208 is tangent to the curve of conduit 218 at a point between member ends 202 and 204, and more preferably at the approximate mid-point of the length of member 200. In one embodiment, conduit 218 forms an arch with a rectangular or circular profile, having an approximately parabolic curve that is tangent to member outer side 208 at the approximate mid-point of the length of member 200. However, the arch of conduit 218 may be altered to have a different configuration and/or follow a different curved profile along the length of member 200, while still remaining within the scope of the present disclosure and the attached claims.

In one embodiment, the curve of conduit 218 defines a center line that passes through the center or radial axis of pivot end opening 212. In another embodiment, conduit 218 may include a rib 222 extending transverse to member 200, between the conduit and member outer side 208. In a preferred embodiment, rib 222 has a length that extends between member end 202 and the tangent point between conduit 218 and member outer side 208.

Conduit 218 comprises a compression reinforcement material 224, as are known in the art. Suitable compression reinforcement materials include Portland cement concrete, Portland cement grout, polymer concrete or ultra high-performance concrete (UHPC). In a preferred embodiment, compression reinforcement 224 comprises Portland cement concrete with a compressive strength of 6,000 pounds per square inch.

Compression reinforcement 224 may be formed within member inner core 216, such as by injection into inner core 216 of outer shell 214. In one embodiment, conduit 218 comprises a hollow tube positioned within inner core 216 for receiving compression reinforcement material 224. For example, conduit 218 may comprise a hollow tube formed from a web or fabric of synthetic material, such as a fiberglass fabric. Compression reinforcement material 224 (e.g., polymer concrete) may be introduced into the hollow tube of conduit 218 by injection. In an alternative embodiment, conduit 218 comprising compression reinforcement 224 may be prefabricated and installed in inner core 216 of member outer shell 214.

Core material 220 fills or partially fills the space between outer shell 214 and conduit 218. In one embodiment, core material 220 is a relatively low density material, such as a low-density foam (e.g., polyisocyanurate, polyurethane, polystyrene), some type of a starch such as a synthetic or processed starch, resins such as polyethylene terephthalate, or fibrous materials such as wood (e.g., bamboo or balsa). Core material 220 may act as an additional shear transfer element or may serve to maintain the form of outer shell 214—e.g., prior to introduction of compression reinforcement 224.

Member 200 may include a tension reinforcement 226 for equilibrating the thrust created in conduit 218 resulting from the hydrostatic pressures caused by the differential elevations of the fluid on either side of the composite lock gate leaf 102. In one embodiment, tension reinforcement 226 extends across the concave side of the curve of conduit 218. For example, tension reinforcement 226 may form a linear rod(s) or a plane that extends along member inner side 206 between member ends 202 and 204. In one embodiment, the ends of tension reinforcement 226 are anchored in compression reinforcement material 224. The top shear flange and bottom shear flange of outer shell 214 also serve to transfer the shear forces between conduit 218 and tension reinforcement 226. In one embodiment, tension reinforcement 226 may be incorporated in the outer shell bottom shear flange.

Figure 9B:
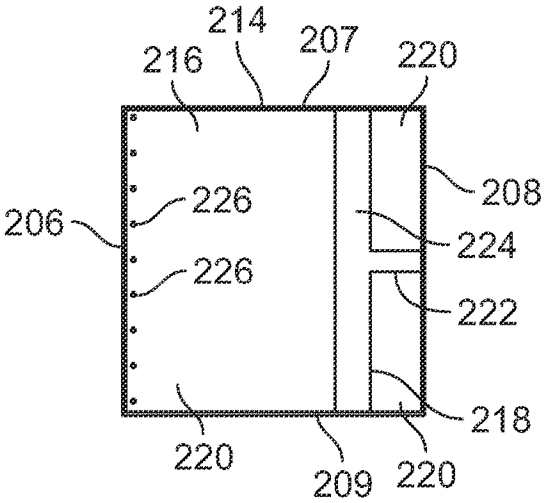
FIG. 9B is a section view of the composite member of FIG. 8B, taken through line B-B.
Figure 9A:
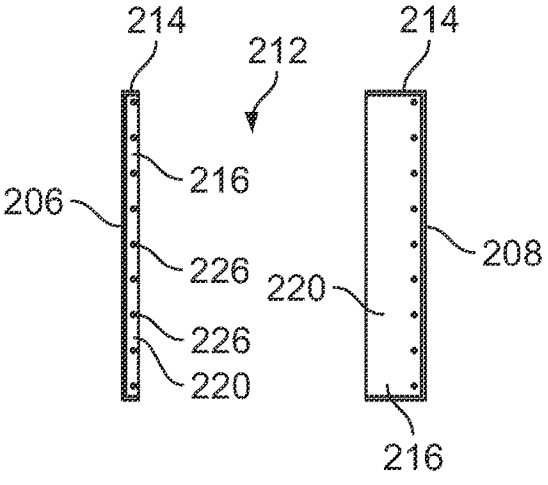
FIG. 9A is a section view of the composite member of FIG. 8B, taken through line A-A.
Figure 9C:
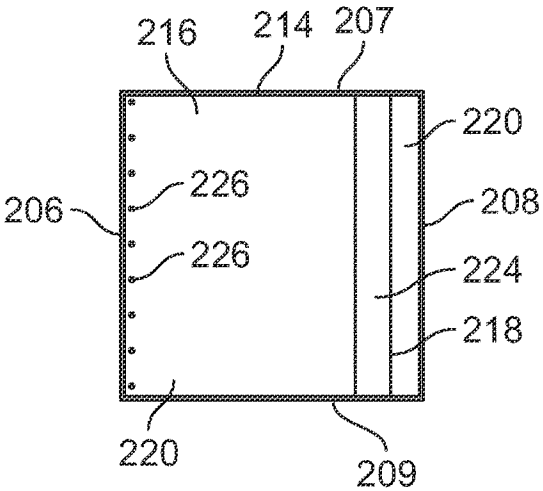
FIG. 9C shows a section view of the composite member of FIG. 8B, taken through line C-C.

In one embodiment, tension reinforcement 226 comprises a plurality of longitudinal high-strength, prestressing rods or strands arranged parallel to each other. In the embodiment of FIGS. 9A-9C, tension reinforcement 226 comprises a plurality of parallel rods that form a plane extending along member inner side 206. The strands or rods may be made of steel or other materials known in the art. Alternatively, tension reinforcement 226 may comprise layers of reinforcing fibers, such as carbon fibers, glass fibers, or aramid fibers. In one embodiment, tension reinforcement 226 extends the length of member 200 from mitre end 204 to pivot end 202, and preferably wraps around pivot hub 210.

The embodiment of FIGS. 6-9 generally shows member 200 having a curved conduit 218 (and compression reinforcement 224), and a linear or planar tension reinforcement 226 extending across the concave side of the curve. For some applications, it may be useful to form member 200 with the reverse configuration—e.g., with tension reinforcement 226 having a curve extending between member ends 202 and 204, and linear or planar conduit 218 extending longitudinally across the concave side of the curve. In one embodiment, tension reinforcement 226 extends longitudinally between member ends 202 and 204, with a curve having a concave side that faces member outer side 208, and a convex side that faces member inner side 206. In a preferred embodiment, member inner side 206 is tangent to the curve of tension reinforcement 226 at a point between member ends 202 and 204, and more preferably at the approximate mid-point of the length of member 200. Conduit 218 and compression reinforcement 224 extend across the concave side of the curve of tension reinforcement 226, and preferably form a plane that extends along member outer side 208.

Inner core 216 may also include one or more intermediate stiffeners (not shown) that extend transversely and are spaced apart along the length of member 200. In one embodiment, the intermediate stiffeners have the same height and width as the internal height and width of outer shell 214, and may be spaced at about six-foot longitudinal intervals along the length of member 200. The intermediate stiffeners may comprise materials similar to outer shell 214, such as glass fiber reinforced plastic. In one embodiment, the illustrative intermediate stiffeners have a thickness of about 0.12 inch. Those of skill in the art will appreciate that the intermediate stiffeners may have different configurations and spacing, and may have different thicknesses depending on the configuration and intended application of members 200.

Members 200 may be assembled quickly and easily to erect composite lock gate leaf 102. The assembly of members 200 can be performed using a crane or other means known in the art. For example, gate leaf 102 may be erected by sequentially placing each member 200 one on top of the other, with the bottom face 209 of a subsequent member positioned on or adjacent to the top face 207 of the preceding member. Each member end 202 is positioned at the quoin pier of lock side wall 6, with pivot hub 208 centered on pivot pin 10.

Figure 10:
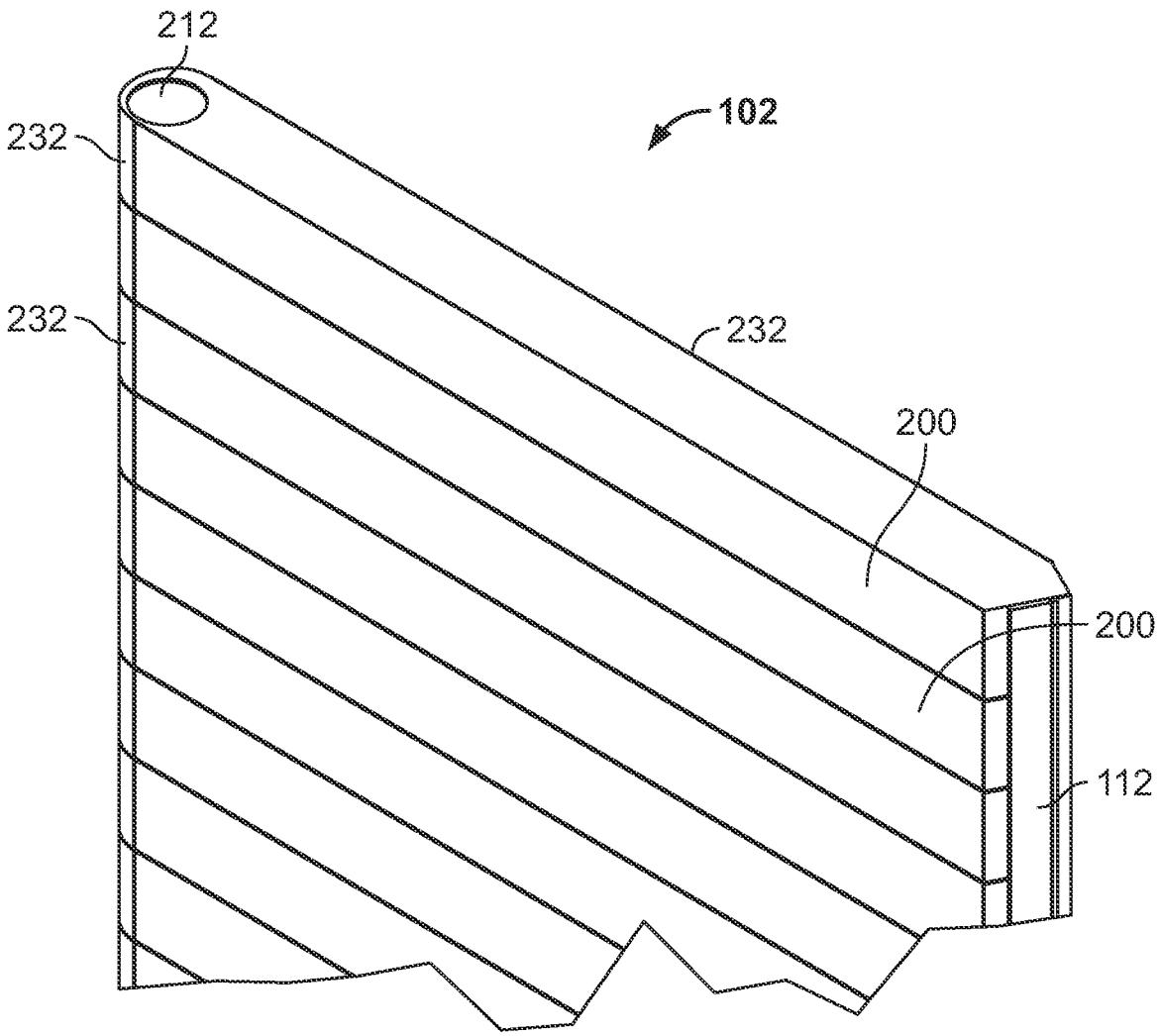
FIG. 10 is a partial perspective view of a lock gate leaf of the lock gate of FIG. 4.

FIG. 10 shows a plurality of members 200 aligned and stacked vertically to form gate leaf 102. A spacer template (not shown) may be positioned between adjacent stacked members 200. In one embodiment, openings 212 of member ends 202 are aligned to form a channel extending the entire height of gate leaf 102 for receiving a pivot pin for rotation of the gate leaf 102, such as pintle pin 10. In another embodiment, member ends 204 are aligned to receive seal 108 extending the height of gate leaf 102, for sealing the mitre joint when gate leaves 102 are in the closed position.

The assembled members 200 may be coupled together by vertical ties extending through each of the members. In one embodiment, pivot hub 210 has one or more vertical conduits 228 (FIG. 7) for receiving the vertical ties. Vertical conduits 228 extend between member top and bottom faces 207 and 209, through outer shell 214 and inner core 216. Once all of members 200 (and the spacer templates) have been erected, the vertical ties are installed in vertical conduits 228 to secure the members together. In one embodiment, the vertical ties comprise steel post-tensioning bars or other type of threaded rods that have anchors (not shown) located on the bottom face 209 of the first (bottom) member 200, and on the top face 207 of the last (top) member 200 of lock gate 102.

Gate leaf 102 may also include sheets 230 and/or 232 that are respectively applied to the inner and outer sides 206 and 208 of the assembled members 200. FIGS. 2 and 3 show an example of an interior face sheet 230 that is applied to the inner sides 206 of the assembled members 200, and forms the interior vertical surface of gate leaf 102. An exterior face sheet 232 may also applied to the outer sides of the assembled members 200, to form the exterior surface of gate leaf 102. In one embodiment, exterior face sheet 232 wraps around the ends 202 and pivot hubs 210 of the assembled members 200, as best shown in FIG. 10.

Face sheets 230 and 232 preferably have a height and width that is approximately the height and width of gate leaf 102—i.e. a width that is approximately the length of members 200 and a height that is approximately the vertical height of the stacked members. Face sheets 230 and 232 preferably extend vertically across all of the stacked member 200 that comprise gate leaf 102. In the embodiment of FIGS. 2 and 3, face sheet 230 extends vertically across and perpendicular to the stacked members 200. However, those of skill in the art will appreciate that face sheets 230 and 232 may have other configurations. For example, face sheet 230 and/or 232 may comprise one or more sheets that extend across stacked members 200 at an angle. In one embodiment, face sheets 230 and/or 232 may comprise a sheet that extends across the stacked members 200 at a 45° angle, such as extending from gate leaf bottom 110 at mitre end 106, to gate leaf top end 108 at pintle end 104.

Face sheets 230 and 232 may be applied to members 200 by various means known in the art, such as fasteners or adhesives. In one embodiment, face sheets 230 and 232 are coupled to members 200 by screws extending through the face sheets into threaded inserts formed in members 200. In an alternative embodiment, the spacer templates may have threaded inserts for fastening face sheets 230 and 232 to the interior and exterior vertical surfaces of gate leaf 102.

The dimensions of members 200 and the number of stacked members may be varied to accommodate the water level height and width of lock chamber 4, or as otherwise may be appropriate for the particular application. In one embodiment, member 200 has a ratio of length:vertical height ratio of about 15:1. For example, member 200 may have a length of about 47 feet from the centerline of pivot hub opening 212 at pivot end 202 to mitre end 204, a vertical height between top and bottom faces 207 and 209 of about 39 inches, and a width between member inner and outer sides 206 and 208 of about 24 inches. Inner core 216 has a conduit 218 with a generally rectangular cross section having a vertical height of about 24 inches and a width of about 6 inches. Twelve members 200 may be vertically stacked to form a lock gate leaf 102 with a height of about 41 feet.

Figure 11:
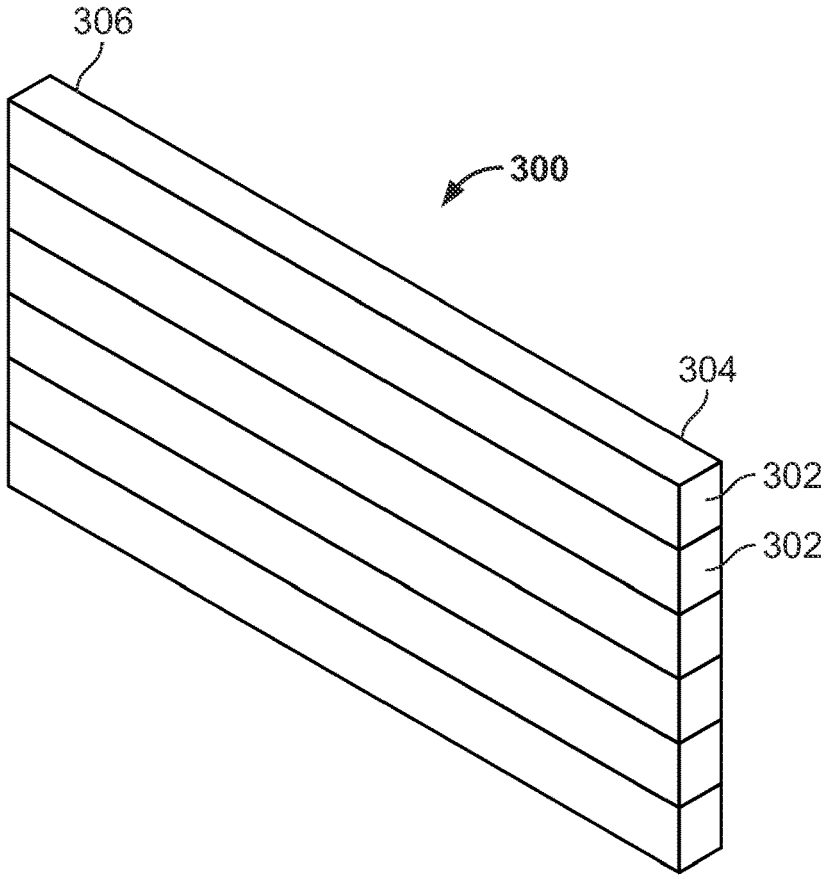
FIG. 11 is a perspective view of an embodiment of a soldier pile dam gate comprising composite members according to the present disclosure.

The composite members may be readily configured to form other types of liquid retaining barriers. FIG. 11 shows an illustrative embodiment of a composite sluice gate, comprising a plurality of composite members 302 that are vertically stacked and coupled to form a planar gate 300. Gate 300 may be incorporated in a sluice gate structure, and may be supported in the slotted spaces of adjacent vertical soldier piles (not shown) with the planer surfaces of gate 300 bearing on the external flanges of the vertical soldier piles, as is known in the art. The sluice gate may be configured to manage the flow of fluid by raising or lowering gate 300.

Members 302 may have a similar structure to member 200, except that members 302 do not require a pivot hub or pivot opening at one end, nor require an end configured to form a mitre joint with another member. Instead, members 302 have opposite ends 304 and 306 that are sized and shaped to be received in the slotted vertical soldier piles. In one embodiment, member ends 304 and 306 are symmetrical—e.g., having mirror image configurations.

Figure 12:
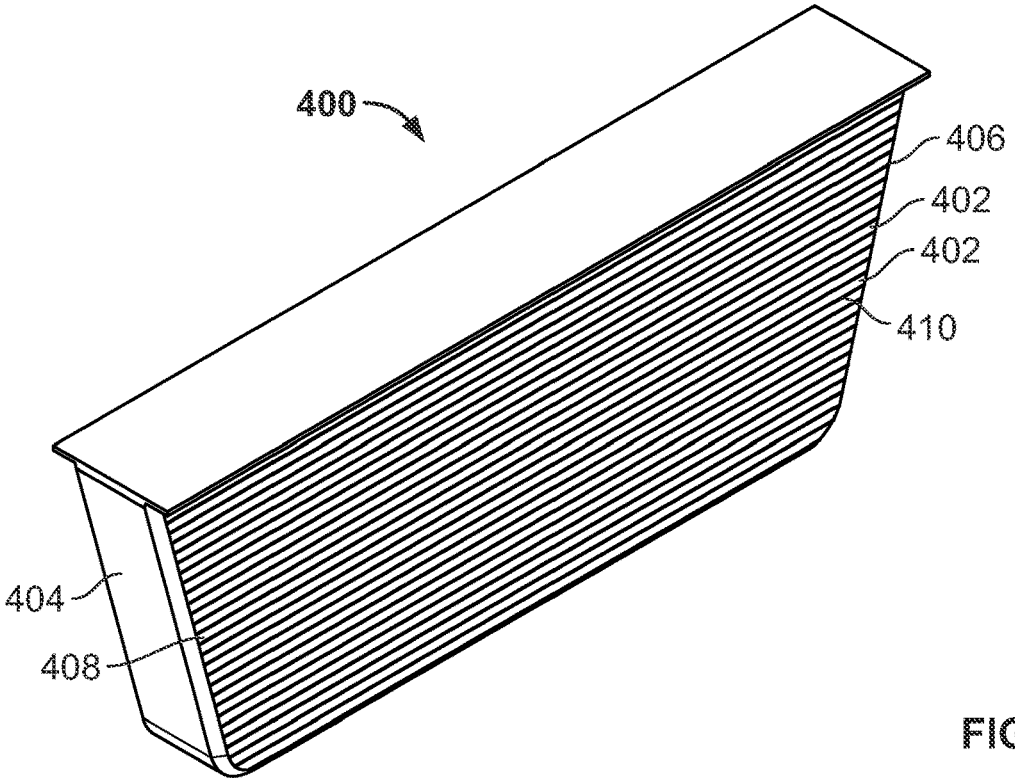
FIG. 12 is a perspective view of an embodiment of a dry dock gate comprising composite members according to the present disclosure.

FIG. 12 shows an illustrative embodiment of a composite dry dock gate, comprising a plurality of composite members 402 that are vertically stacked and coupled to form a planar gate 400. Gate 400 may be configured as a floating caisson gate with opposite ends 404 and 406 that are sized and shaped to conform to the opening of the dry dock (not shown), as is known in the art.

Members 402 may have a similar structure to member 200, except that members 402 also do not require a pivot hub or pivot opening at one end, nor require an end configured to form a mitre joint with another member. Instead, members 402 have opposite ends 408 and 410 that are sized and shaped to respectively form gate ends 404 and 406. In one embodiment, the members 402 comprising gate 400 have varying lengths between ends 408 and 410. When members 402 are stacked in the proper sequence and alignment, their combined member ends 408 and combined member ends 410 respectively form gate ends 404 and 406 that conform to the opening of the dry dock.

In one embodiment, the dry dock opening has a tapered shape to facilitate the vertical removal of the floating caisson gate 400. The combined member ends 408 and combined member ends 410 respectively form complementary tapered gate ends 404 and 406, as shown in FIG. 12. In the closed position, planar tapered gate 400 is supported in the complementary shaped dry dock opening. When ballast is removed from gate 400, the planer structure is lifted vertically by a buoyancy force and can be floated out of the tapered dry dock opening.

FIGS. 13-16 show an embodiment of a modular vertical barrier 500, comprising horizontal members 502, spacers 504, and inner and outer sheets 506 and 508. For convenience, horizontal members 502 are illustrated in simplified form as an outer shell 510, but may have a similar structure to members 200, 300, or 400. Members 502 are stacked vertically to form barrier 500, with each pair of vertically adjacent members 502 separated by a spacer 504. The assembly of members 502 and spacers 504 is coupled together by inner and/or outer sheets 506 and 508.

Figure 16:
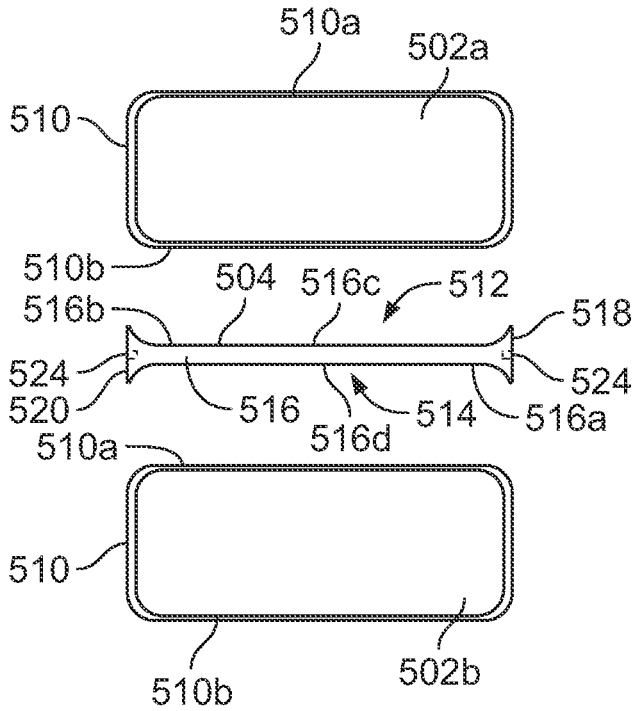
FIG. 16 is an exploded side section view of a spacer and adjacent horizontal members of the modular barrier of FIG. 13.

Spacers 504 preferably provide a template to facilitate the vertical assembly of members 502 to form barrier 500. In one embodiment, spacer 504 has a channel for receiving a member 502, and preferably has two opposed channels for receiving two adjacent members 502. FIG. 16 shows a spacer 504 positioned between two vertically adjacent upper and lower members 502*a* and 502*b*. Top and bottom channels 512 and 514 are formed on opposite (top and bottom) sides of spacer 504, for respectively receiving and aligning members 502*a* and 502*b*.

In one embodiment, spacer 504 comprises a body 516 with opposite inner and outer ends 516*a* and 516*b*, and opposite top and bottom sides 516*c* and 516*d*. The width of body 516 between inner and outer ends 516*a* and 516*b* is about the width of members 502. Inner and outer flanges 518 and 520 are respectively positioned at body ends 516*a* and 516*b*, and extend vertically above and/or below body 516. Top channel 512 is U-shaped, with a base formed by body top side 516*c*, and walls formed by vertically extending flanges 518 and 520. U-shaped, bottom channel 514 is similarly formed by body bottom side 516*d*, and flanges 518 and 520.

Two vertically adjacent (upper and lower) members 502*a* and 502*b* are received in channels 512 and 516. As shown in FIG. 16, top channel 512 receives upper member 502*a*, and is preferably sized and shaped to receive the bottom face 510*b* of the upper member. Bottom channel 514 similarly receives bottom member 502*b*, and is preferably sized and shaped to receive the top face 510*a* of the bottom member. Top and bottom channels 512 and 514 are preferably configured to vertically align the received members 502*a* and 502*b*. The walls of U-shaped channels 512 and 514 formed by inner and outer flanges 518 and 520 retain members 502*a* and 502*b* in alignment, and resist transverse shear stress on barrier 500 and horizontal slipping of the vertically stacked members.

Figure 15:
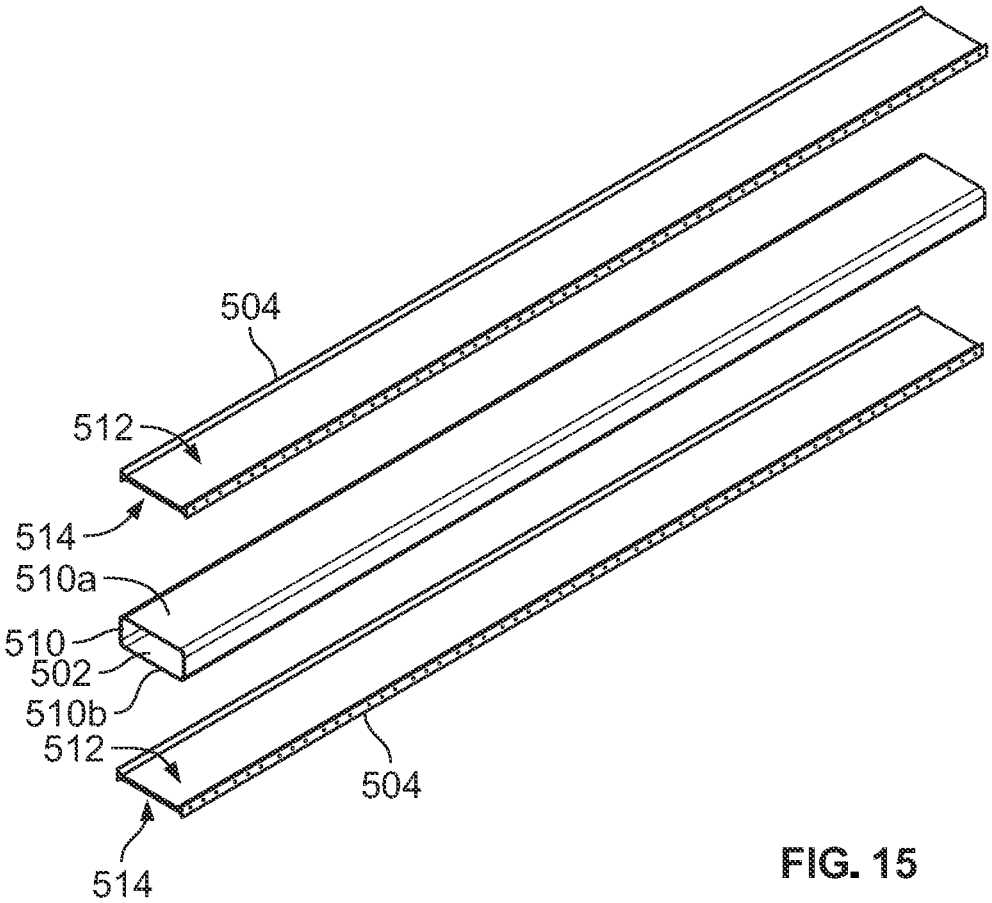
FIG. 15 is an exploded perspective view of a horizontal member and adjacent spacers of the modular barrier of FIG. 13.

FIG. 15 shows spacers 504 that have a length which extends the length of member 502. Alternatively, spacers 504 may be less than the length of member 502, such that the spacers cover only a portion of the length of members 502. Alternatively, multiple spacers 504 may be combined to extend across the length of member 502, or to cover separate segments along the length of the member.

Spacers 504 may also be used to modify the buoyancy of barrier 500. In one embodiment, barrier 500 incorporates multiple spacers 504 that have different densities—e.g., comprising metals, polymers, and combinations thereof to vary the density of the spacers. The buoyancy of barrier 500 may be varied by incorporating spacers 504 having an appropriate density, or combinations of different spacers 504 that result in the desired buoyancy. For example, where barrier 500 comprises a floating caisson gate for a dry dock, spacers 504 may be selected such that the barrier has neutral buoyancy.

Alternatively, the members may be self-assembling or self-aligning, without the need for spacers 504. In one embodiment, members 502 (e.g., top and/or bottom faces 510*a*, 510*b*) are formed with channels for receiving adjacent members, that function similarly to spacers 504. For example, vertical flanges may extend from member top face 510*a* to form a U-shaped top channel similar to channel 512 for receiving the bottom face 510*b* of an adjacent member 502. Alternatively, vertical flanges may extend from member bottom face 510*b* to form a U-shaped top channel similar to channel 514 for receiving the top face 510*a* of an adjacent member 502.

Sheets 506 and 508 are positioned on the inner and outer faces of barrier 500, and assist in coupling the vertically stacked members 502. Sheets 506 and 508 also resist shear stress on barrier 500, and provide impact resistance. In one embodiment, sheets 506 and/or 508 are coupled to spacers 504 by various means known in the art, including adhesives, fasteners such as screws or bolts, and combinations thereof. In one embodiment, sheets 506 and/or 508 have openings 522, and spacers 504 have corresponding openings 524 for receiving fasteners to couple the sheets to the spacers. In one embodiment, the fasteners are tie rods that are received in openings 522 and 524, and extend through body 516 of spacers 504 and sheets 506 and 508. In another embodiment, openings 524 are formed in members 502 for receiving the fasteners to couple sheets 506 and 508 to the members.

Figure 13:
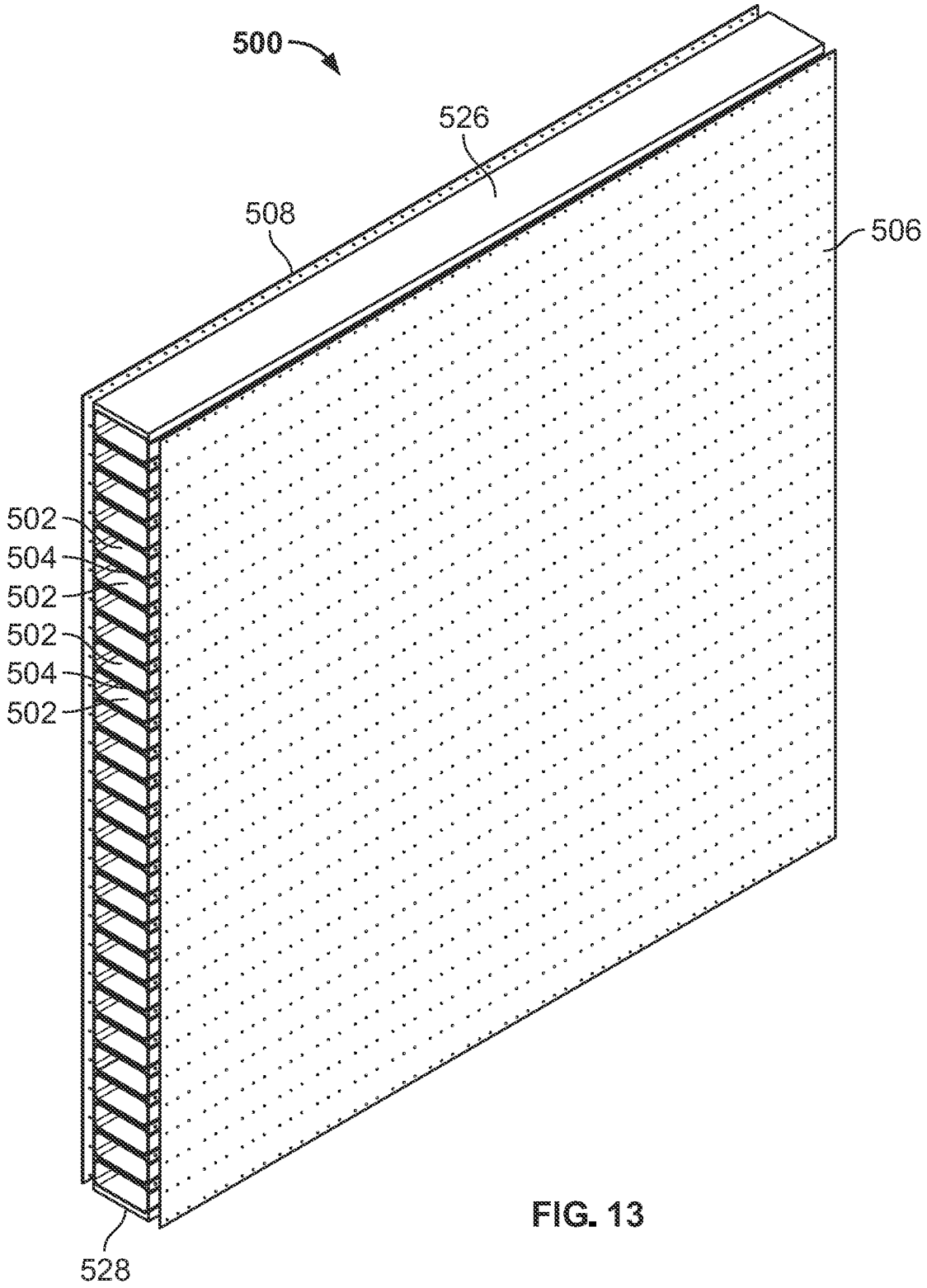
FIG. 13 is a perspective view of an embodiment of a modular barrier.
Figure 14:
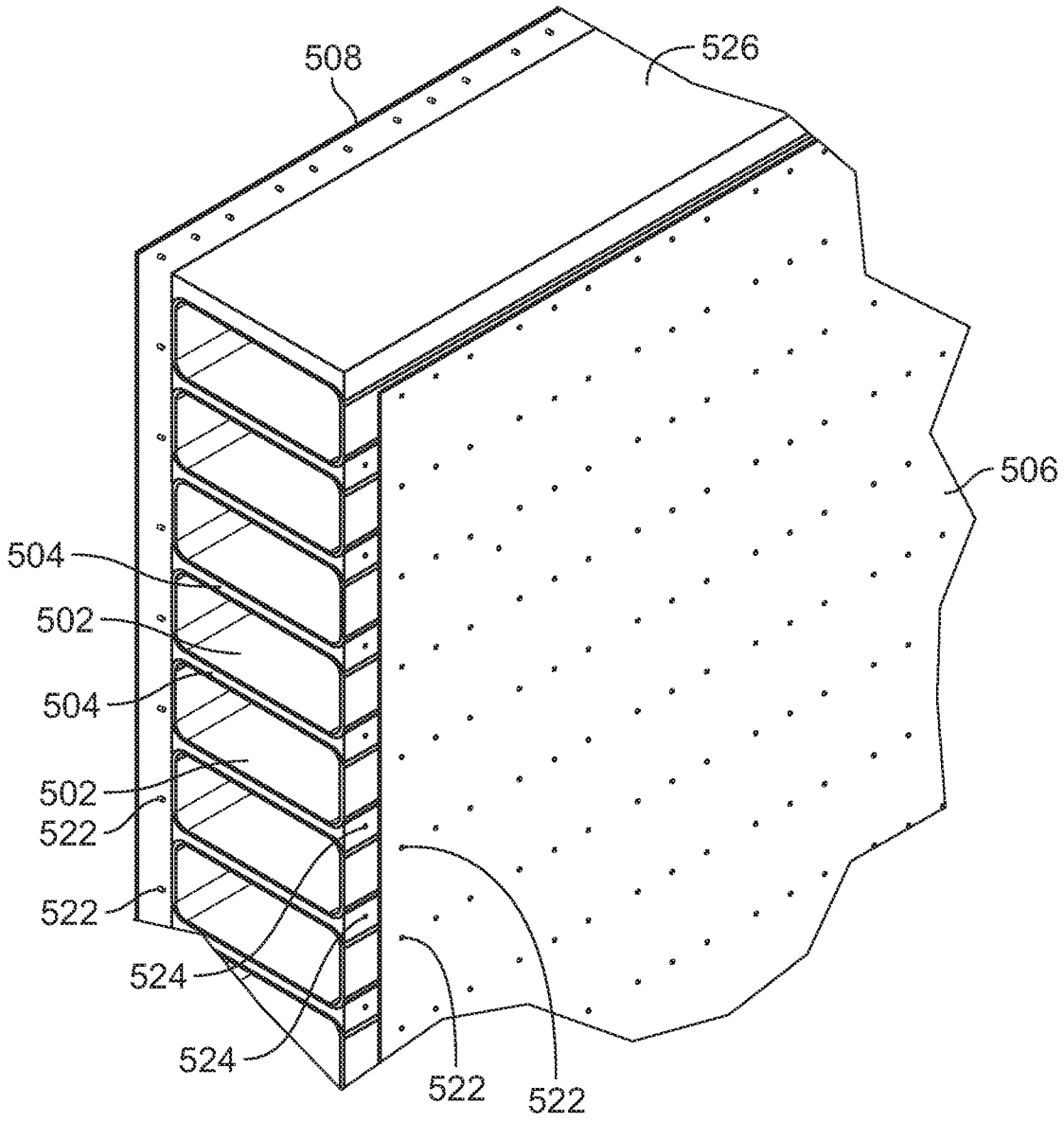
FIG. 14 is a detail perspective view of the modular barrier of FIG. 13.

In one embodiment, unitary sheets 506 and 508 respectively cover substantially the entire inner and/or outer faces of barrier 500, as best shown in FIG. 13. Alternatively, sheets 506 and/or 508 may be modular, and comprise multiple segments or sub-sheets that combine to cover substantially the entire face of barrier 500, or may be configured to cover only selected portions of the barrier face. In addition, sheets 506 and/or 508 may also provide a template or frame for the vertical assembly and alignment of members 502.

Sheets 506 and 508 may be made of different materials and/or have different thicknesses. Where barrier 500 is a fluid retaining barrier (e.g., lock gate, sluice gate, dry dock gate), sheets 506 and/or 508 are preferably made of corrosion resistant materials, such as glass fiber reinforced polymer, polyethylene terephthalate (PET), and other polymer and polymer composite materials. Where enhanced impact resistance and/or stiffness are required, sheets 506 and/or 508 may be made of metal (e.g., steel), and laminates of polymer and/or polymer composite materials with steel. Alternatively, sheets 506 and/or 508 may incorporate protective structures and/or sacrificial materials such as a wood guard or bumper. Sheets 506 and/or 508 may also be used to modify the buoyancy of barrier 500, by incorporating buoyant materials such as synthetic foams known in the art. For example, Sheets 506 and/or 508 may comprise a sandwich of closed-cell polyurethane foam sandwiched between metal, polymer, and/or polymer composite layers. In addition, sheets 506 and/or 508 may include other features known in the art, such as exterior coatings for impact resistance and/or corrosion resistance, and paints for signage.

The terminal members 502 of the vertical stack that are positioned at the top and bottom of barrier 500, may be exposed or may be respectively covered with end caps 526 and 528. Top and bottom end caps 526 and 528 may be configured to protect the top and bottom members 502 from the environmental conditions and/or may be adapted for certain applications. For example, where barrier 500 comprises a lock gate, bottom end cap 528 may be configured to receive the cill of the lock chamber. In another embodiment, top end cap 526 may be configured to receive pedestrian or vehicular traffic.

The above examples describe planar barrier structures, and the stacked composite members are shown having generally rectangular cross-sections. However, the members may also be adapted for use in curved barrier structures, such as a radial gate or tainter gate which has a curved vertical profile that generally comprises a section of a cylinder. In one embodiment, the curved barrier may be formed by the offset alignment of the members—e.g., similar to a staircase approximation of a curve. For example, sheets 506 and 508 may have a vertically curved profile and/or spacer channels 512 and 514 may be offset to provide a template for the assembly of members 500 to form a curved barrier. In another embodiment, the curve may be incorporated in the configuration of the members. For example, the member outer side may be formed with an angled or curved profile, such that the member has a generally trapezoidal cross-section and the alignment of the outer sides of the stacked members forms a barrier with a curved profile.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

What is claimed is:

1. A modular barrier, comprising:

a plurality of vertically stacked members that are coupled together, including a top member and a bottom member, each member comprising:

opposite first and second ends, a length between the first and second ends, opposite inner and outer sides, and opposite top and bottom faces;

an outer shell extending at least partially around a perimeter of the member formed by the inner side, outer side, top face, and bottom face, the outer shell having an inner core space; and a curved conduit positioned in the inner core space and extending between the first and second ends, the conduit having a concave side facing the member inner side, and a convex side facing the member outer side;

wherein at least one of the top and bottom members has a first end comprising a hub with an opening for receiving a pin, and wherein the barrier is rotatable on the pin.

2. The modular barrier of claim 1, wherein the outer shell comprises a corrosion resistant material.

3. The modular barrier of claim 2, wherein the corrosion resistant material is a glass fiber reinforced polymer.

4. The modular barrier of claim 1, wherein the member outer side is tangent to the conduit convex side at a point between the member first and second ends.

5. The modular barrier of claim 1, wherein the conduit comprises a compression reinforcement material selected from the group consisting of: Portland cement concrete, Portland cement grout, polymer concrete and ultra high-performance concrete.

6. The modular barrier of claim 1, wherein the inner core space between the outer shell and the conduit is at least partially filled with a core material selected from the group consisting of: a polyisocyanurate foam, a polyurethane foam, and a polystyrene foam.

7. The modular barrier of claim 1, further comprising a vertical tie extending through the vertically stacked members, wherein the vertically stacked members are coupled together by the vertical tie.

8. The modular barrier of claim 1, wherein the plurality of vertically stacked members comprises adjacent vertically stacked first and second members, and further comprising a spacer positioned between the first and second members, wherein the first and second members are coupled together by the spacer.

9. The modular barrier of claim 8, wherein the spacer comprises:

a body having opposite first and second sides, and opposite first and second ends;

a first and second flanges respectively positioned at the first and second ends;

a first channel formed by the first side, and first and second flanges, the first channel sized and shaped to receive the first member; and a second channel formed by the second side, and first and second flanges, the second channel sized and shaped to receive the second member;

wherein the first and second members are vertically aligned by the spacer.

10. The modular barrier of claim 9, wherein the first channel is sized and shaped to receive the bottom face of the first member, and the second channel is sized and shaped to receive the top face of the second member.

11. The modular barrier of claim 1, further comprising a face sheet extending across the outer sides of the vertically stacked members, wherein the vertically stacked members are coupled together by the face sheet.

12. The modular barrier of claim 11, wherein the face sheet comprises a corrosion resistant material.

13. The modular barrier of claim 12, wherein the corrosion resistant material is a glass fiber reinforced polymer.

14. The modular barrier of claim 11, further comprising a spacer positioned between adjacent vertically stacked members, wherein the face sheet is coupled to the spacer.

15. The modular barrier of claim 1, wherein the curved conduit has a center line, the hub opening has a center, and the conduit center line passes through the center of the hub opening.

16. A modular barrier, comprising:

a plurality of vertically stacked members that are coupled together, each member comprising:

opposite first and second ends, a length between the first and second ends, opposite inner and outer sides, and opposite top and bottom faces;

an outer shell extending at least partially around a perimeter of the member formed by the inner side, outer side, top face, and bottom face, the outer shell having an inner core space; and a curved conduit positioned in the inner core space and extending between the first and second ends, the conduit having a concave side facing the member inner side, and a convex side facing the member outer side; and a ballast removably received in at least one of the plurality of vertically stacked members.

17. The modular barrier of claim 16, wherein the ballast is removably received in the inner core space between the outer shell and the conduit.

18. The modular barrier of claim 16, wherein the plurality of vertically stacked members form a floating caisson gate for an opening of a dry dock; and wherein the buoyancy of the floating caisson gate is controlled by the amount of ballast received in the member.

19. The modular barrier of claim 18, wherein first and second ends of the plurality of vertically stacked members form tapered floating caisson gate ends.

20. A modular barrier, comprising:

first and second gates, each gate comprising a plurality of vertically stacked members that are coupled together, each member comprising:

opposite first and second ends, a length between the first and second ends, opposite inner and outer sides, and opposite top and bottom faces;

an outer shell extending at least partially around a perimeter of the member formed by the inner side, outer side, top face, and bottom face, the outer shell having an inner core space; and a curved conduit positioned in the inner core space and extending between the first and second ends, the conduit having a concave side facing the member inner side, and a convex side facing the member outer side;

wherein the vertically stacked members comprise a top member and a bottom member, at least one of the top and bottom members having a first end comprising a hub with an opening for receiving a pin, wherein the gate is rotatable on the pin;

wherein the vertically stacked members of the second gate are arranged in a mirror image of the vertically stacked members of the first gate; and wherein the barrier is moveable between a closed position with the first and second gates rotated toward each other and the member second ends of the first gate in contact with the member second ends of the second gate, and an open position with the first and second gates rotated away from each other and the member second ends of the first gate rotated away from contact with the member second ends of the second gate.

21. The modular barrier of claim 20, wherein the barrier in the closed position forms a mitre joint between the member second ends of the first and second gates.

22. The modular barrier of claim 20, further comprising a seal positioned at the member second ends of at least one of the first and second gates.

* * * * *